US005147729A

United States Patent [19]

Ogishi et al.

[11] Patent Number: 5,147,729

[45] Date of Patent: Sep. 15, 1992

[54] STEEL PLATE WITH ORGANIC COATING HAVING IMPROVED CORROSION RESISTANCE IN AS-WORKED STATE

[75] Inventors: Hideo Ogishi; Kenji Takao; Shigeru Umino; Koji Yamato, all of Chiba, Japan

[73] Assignee: Kawasaki Steel Corporation, Japan

[21] Appl. No.: 784,130

[22] Filed: Oct. 29, 1991

Related U.S. Application Data

[63] Continuation of Ser. No. 502,066, Mar. 29, 1990, abandoned.

[30] Foreign Application Priority Data

Mar. 31, 1989 [JP] Japan ..... 1-80759

[51] Int. Cl.[5] ..... B32B 15/04

[52] U.S. Cl. ..... 428/623; 428/626; 428/632; 428/659

[58] Field of Search ..... 428/623, 626, 632, 659, 428/684

[56] References Cited

U.S. PATENT DOCUMENTS

| | | | |
|---|---|---|---|
| 4,407,899 | 10/1983 | Hara et al. | 428/626 |
| 4,775,600 | 10/1988 | Adaniya et al. | 428/626 |
| 4,889,775 | 12/1989 | Adaniya et al. | 428/626 |
| 4,959,277 | 9/1990 | Saeki et al. | 428/626 |

FOREIGN PATENT DOCUMENTS

| | | |
|---|---|---|
| 230320 | 7/1987 | European Pat. Off. . |
| 62-289274 | 12/1987 | Japan . |
| 63-35798 | 2/1988 | Japan . |
| 1-8033 | 1/1989 | Japan . |

*Primary Examiner*—George Wyszomierski
*Attorney, Agent, or Firm*—Austin R. Miller

[57] ABSTRACT

The improved corrosion-resistant steel plate with an organic coating comprises a steel plate having a zinc or zinc alloy plate layer which is overlaid with a chromate film which in turn is coated with an organic resin paint film. The organic resin coat comprises an epoxy resin which is prepared by reacting with an isocyanate compound and has a dialkanolamine incorporated into its bisphenol A skeleton, and silica. The dialkanolamine combines with a urethane-modified epoxy resin to provide satisfactory curability at low temperatures; at the same time, it combines with the silica to provide a satisfactory film reinforcing effect. The organic coat formed of this composition can be effectively cured at low temperatures and yet it will neither dissolve nor soften upon swelling under the action of the alkali that is generated during cationic electrodeposition at the interface between the electrodeposited film and the organic coat. Thus, the organic coat has good paint adhesion, high corrosion resistance, as well as good workability and as-worked corrosion resistance and makes the steel plate suitable for us an automotovie part after painting.

4 Claims, No Drawings

STEEL PLATE WITH ORGANIC COATING HAVING IMPROVED CORROSION RESISTANCE IN AS-WORKED STATE

This application is a continuation of application Ser. No. 07/502,066, filed Mar. 29, 1990, abandoned.

BACKGROUND OF THE INVENTION

1. Field of the Invention

This invention relates to a rust preventive steel plate with organic coating for use in automotive parts that has improved cationic electrodeposition coating quality, workability, weldability, and corrosion resistance.

2. Description of the Prior Art

In response to the growing need for increasing the corrosion resistance of automotive steel plates, various types of corrosion preventive steel plates have been proposed and are being gradually accepted by the industry. The first to be mentioned of these corrosion preventive steel plates are plated ones such as those prepared by hot dipping molten zinc or zinc alloys or by electroplating zinc or zinc alloys. However, these plated steel plates are not completely satisfactory for use in curled or hemmed portions of inner plates of car bodies where particularly high corrosion resistance is required on the surface.

Zinc chromated steel plates provided with zinc-rich coatings are known to have high corrosion resistance. However, if such steels having corrosion preventive coatings are subjected to mechanical working such as press forming, the coating can separate from the substrate to cause deterioration in corrosion resistance.

With a view to solving these problems, it was recently proposed that thin organic films (0.3–3 μm) entirely free from electroconductive pigments be formed on the substrate plate of steel plates to make them amenable to subsequent coating by electrodeposition. Such steel plates are described in Japanese Laid-Open (kokai) Application Nos. 62-289274, 63-22637 and 63-35798. These steel plates with organic coatings are improved in many aspects including corrosion resistance, weldability, press formability, and the waterproofing secondary adhesion after electrodeposition coating. However, these improvements can only be achieved when the organic coating is fully crosslinked with a crosslinking agent.

One of the practices gaining popularity today is to make steel plates of "bake hardenable" materials that have low yield strength prior to press forming but that will increase in yield strength upon baking of subsequently coated films. In order to fully exploit the bake hardenability of such materials, the heating of organic coatings for drying and curing them must be performed at temperatures not higher than 150° C. In special cases where high production rates are of primary importance, it is required that the temperature of 150° C. be reached within one minute and that no retention time be provided. These requirements are very strict and unfavorable for the purpose of completely drying and curing the organic coatings. In fact, the conventional organic coatings are made of resin systems that should be fully crosslinked in order to exhibit their intended functions, so they cannot be crosslinked by a satisfactory degree if they are subjected to the low-temperature, rapid heating described above. During subsequent cationic electrodeposition coating, such insufficiently crosslinked organic coatings will dissolve or become soft upon swelling on account of the alkali that is generated at the interface between the electrodeposited coating and the organic coating, to thereby deteriorate the paint adhesion and corrosion resistance of the applied coatings.

BRIEF SUMMARY OF THE INVENTION

An object of the present invention is to solve the aforementioned problems of the prior art and provide a steel plate that has an organic coating that can be cured by low-temperature, rapid heating and which yet has improved properties such as good electrodeposition coating quality, strong paint adhesion, high corrosion resistance, and particularly high corrosion resistance in as-worked state.

According to the present invention, there is provided a steel plate with organic coating having improved corrosion resistance in as-worked state, which steel plate comprises a zinc or zinc alloy plated steel plate having on its surface a chromate film deposited in an amount of 5–500 mg/m$^2$ in terms of metallic chromium, said chromate film being overlaid with a solid film that is deposited in an amount of 0.3–4.0 g/m$^2$ and that is formed of a paint composition that consists of 100 parts by weight of a modified epoxy resin having 0.5–1.0 mole of a dialkanolamine added per equivalent of epoxy groups in a urethane-modified epoxy resin that has epoxy equivalent of 1,000–5,000 and that is prepared by reacting 100 parts by weight of an epichlorohydrin-bisphenol A type epoxy resin with 10–100 parts by weight of an isocyanate compound, and 10–150 parts by weight of silica on a solid basis.

Preferably, said chromate film is deposited in an amount of 10–200 mg/m$^2$ in terms of metallic chromium.

More preferably, said solid film is deposited in an amount of 0.5–2.0 g/m$^2$.

Further preferably, said dialkanolamine is at least one member selected from the group consisting of diethanolamine, dipropanolamine and dibutanolamine.

In the present invention, an epichlorohydrin-bisphenol A type epoxy resin is reacted with an isocyanate compound in order to impart good workability to the skeleton of said epoxy resin. Further, a dialkanolamine is added to the epoxy groups in the resin. The addition of a dialkanolamine allows a highly active primary hydroxyl group to be introduced at the terminals of the epoxy resin and the strong interaction between the primary hydroxly group and silica provides a sufficient film reinforcing effect to produce an organic coating that exhibits satisfactory alkali resistance. Stated more specifically, even if the organic coating is baked by low-temperature, rapid heating, if can safely be subjected to cationic electrodeposition coating without dissolving out or becoming soft upon swelling under the action of the alkali that is generated at the interface between the electrodeposited coating film and the resin coating. Hence, the organic coating on the steel plate of the present invention insures good paint adhesion. Further, it has particularly high corrosion resistance in as-worked state since the resin itself is provided with good workability.

DETAILED DESCRIPTION OF THE INVENTION

The present invention is described below in detail.

The steel plate used in the present invention may be plated with various metals by various methods, including electro zinc plating, zinc hot dipping, electro zinc alloy plating (e.g. Zn-Ni, Zn-Fe, Zn-Al or Zn-Mn), plating with alloyed molten zinc, plating with molten zinc alloys (e.g. Zn-Al, Zn-Fe or Zn-Mg), aluminum hot dipping, and dispersive plating. If desired, different metals or alloys may be plated in multiple layers.

The surface of this plated steel plate is chromated in order to provide improved adhesion to an organic coating to be subsequently applied and hence to improve its corrosion resistance. The chromate film is suitably deposited in an amount of 5–500 mg/m$^2$ in terms of metallic chromium. Below 5 mg/m$^2$, not only corrosion resistance but also the adhesion to a later formed organic coating is insufficient. Above 500 mg/m$^2$, workability and weldability will be impaired. A deposit of 10–200 mg/m$^2$ is preferred since even better corrosion resistance and weldability can be provided.

The chromate treatment may be performed by any known technique such as a reactive method, a coating method or an electrolytic method.

The conditions that have to be met in forming an organic high-molecular weight resin film on top of the thus provided chromate film are described below.

The epichlorohydrin-bisphenol A type epoxy resin to be used in the present invention is the condensation product that is formed by condensing bisphenol A with epichlorohydrin alone. In addition to the epichlorohydrin-bisphenol A type epoxy resin, other epoxy resins could be used, such as those which are solely composed of an aliphatic epoxy resin or an alicyclic epoxy resin structure, which may be copolymerized with a bisphenol A type epoxy resin, as well as epoxy esters formed by reacting such epoxy resins with a dicarboxylic or monocarboxylic acid. However, in order to attain high corrosion resistance in worked areas, the use of an epichlorohydrin-bisphenol A type epoxy resin is most preferred. Such epoxy resins are commercially available under such trade names as Epikote 1001, 1004, 1007, and 1009 (all being products of Shell Chemical Co.), which may be used either on their own or as admixtures.

In order to impart good workability to these resins and to provide them with alkali resistance by increasing their molecular weight, the epichlorohydrin-bisphenol A type epoxy resin is reacted with an isocyanate compound, whereby a urethane-modified epoxy resin having epoxy equivalent of 1,000–5,000 is obtained.

In reacting the epichlorohydrin-bisphenol A type epoxy resin with an isocyanate compound, the latter is preferably used in an amount of 10–100 parts by weight per 100 parts by weight of the epoxy resin. If less than 10 parts by weight of the isocyanate compound is used per 100 parts by weight of the epoxy resin, not only is it impossible to impart adequate workability but also the increase in the molecular weight of the resin is insufficient to insure satisfactory alkali resistance and the resin film will dissolve or become soft upon swelling during subsequent electrodeposition coating, whereby the paint adhesion of the electrodeposited film will deteriorate. If, of the other hand, more than 100 parts by weight of the isocyanate compound is used, the resin will have an unexcessively high molecular weight. This unavoidably increases the viscosity of the paint, thereby making it difficult to perform efficient coating operations.

The isocyanate compound to be used in the present invention is an aliphatic, alicylic or aromatic compound that have at least two isocyanate groups in the molecule, or the partial reaction product of these compounds with polyhydric alcohols. Exemplary isocyanate compounds include m- or p-phenylene diisocyanate, 2,4- or 2,6-tolylene diisocyanate, p-xylene diisocyanate, hexamethylene diisocyanate and isophorone diisocyanate, which may be used either of their own or as admixtures or partially reacted with polyhydric alcohols (i.e. dihydric alcohols such as ethylene glycol and propylene glycol, or polyhydric alcohols such as glycerin, trimethylolpropane, pentaerythritol, sorbitol, and dipentaerythritol) to provide compounds having at least two residual isocyanate groups in the molecule. The reaction between the epichlorohydrin-bisphenol A type epoxy resin and the isocyanate compound may be performed satisfactorily even in the absence of a catalyst but if necessary, a known catalyst such as a tertiary amine or an organic compound may be added.

The urethane-modified epoxy resin to be obtained in the above manner must have epoxy equivalents within the range of 1000–5,000. If the epoxy resin has less than an epoxy equivalent of 1,000, the molecular weight of the resin is too low to insure satisfactory alkali resistance and strong paint adhesion will not be attained after electrodeposition. If the epoxy resin has more than an epoxy equivalent of 5,000, as the amount of the epoxy groups becomes low, the amount of dialkanolamine to be added to epoxy groups is so small that the intended film reinforcing effect to be achievable by interaction with silica can not be obtained to the fullest extent.

Furthermore, the dialkanolamine is preferably added to epoxy groups of the urethene-modified epoxy resin having an epoxy equivalent of 1,000–5,000 to be obtained in this way in an amount of 0.5–1.0 mole per equivalent of epoxy groups. If the amount of dialkanolamine added is not less than 0.5 moles per equivalent of epoxy groups, the intended film reinforcing effect to be achievable by interaction with silica can be obtained, so that the organic resin film will be prevented from swelling on account of the alkali that is generated during electrodeposition coating at the interface with the resin film and the overlying electrodeposited film, and this prevents deterioration in the adhesion between the two films. If the dialkanolamine is added in an amount exceeding 1.0 mole per equivalent of epoxy groups, there occurs excess dialkanolamine which is not added to epoxy group and that will not take part in combining with silica to provide a film reinforcing effect. Such excess dialkanolamine is not only uneconomical but it also remains unreacted in the resin film to deteriorate such factors as corrosion resistance and waterproofing secondary adhesion.

Examples of the dialkanolamine t be used in the present invention include diethanolamine, dipropanolmaine, dibutanolamine, etc. Dialkanolamine has the advantage that it is capable of introducing a greater amount of primary hydroxyl groups and this contributes to an enhancement of the film reinforcing effect that is achieved by combination with silica, thus leading to a further improvement in curability at low temperatures.

In the present invention, the corrosion resistance of the resin film formed of the composite resin composing the epoxy resin, the isocyanate compound, and the dialkanolamine is further improved by incorporating silica in said composite resin Silica is incorporated in an amount, on a solid basis, of 10–150 parts by weight, per 100 parts by weight, on a solid basis, of the base resin (modified epoxy resin). If the silica content is less than 10 parts by weight per 100 parts by weight of the base resin, the desired improvement in corrosion resistance is not achievable. If the silica content exceeds 150 parts by weight per 100 parts by weight of the base resin, the adhesion to a second coat and the workability of the coated steel plate will deteriorate. The silica to be incorporated in the resin composition may be either colloidal silica or fumed silica.

The resin composition having the formula described above may be applied to the top surface of the chromate film on the galvanized or otherwise plated steel plate by any suitable coating method such as roll coating, spray coating or shower coating. For drying and curing purposes, the steel plate need only be heated at a temperature of 100°-200° C. A particular advantage of the present invention is that the applied resin composition can be adequately cured simply by heating at 150° C. or below, so even a bake hardenable steel plate can be used as a substrate without the risk of sacrificing its bake hardenability.

The resin composition must be applied in such a dry thickness that it is deposited as a solid film in an amount of 0.3-4.0 g/m$^2$. If the resin deposit is less than 0.3 g/m$^2$, satisfactory protection against corrosion is not insured. If the resin deposit exceeds 4.0 g/m$^2$, it undesirably causes deterioration in the workability. The preferred resin deposit is within the range of 0.5-2.0 g/m$^2$ since further improvement in spot weldability can be achieved.

As described in detail on the foregoing pages, the steel plate of the present invention has an organic coating formed of a resin composition that comprises an epoxy resin, an isocyanate compound, a dialkanolamine, and silica in specified proportions. The organic coating formed of this resin composition can be effectively cured by rapid heating at low temperatures, and even if it is later subjected to cationic electrodeposition coating, the resin film will neither dissolve nor soften upon swelling under the action of the alkali that is generated during electrodeposition coating at the interface between the electrodeposited film and the resin film. Therefore, the organic coating on the steel plate of the present invention has good electrodeposition coating quality, strong adhesion between coated films and satisfactory corrosion resistance. Because of these advantages, the steel plate with organic coating of the present invention can successfully be painted and used as automotive parts.

EXAMPLES

The following examples are provided for the purpose of further illustrating the present invention but are in no way to be taken as limiting.

EXAMPLE

(A) Preparation of isocyanate compound

A reactor equipped with a reflux condenser, a stirrer, a thermometer and a nitrogen gas blowing pipe was charged with 528 parts of hexamethylene diisocyanate and 620 parts of metyl isobutyl ketone. The charge in uniform solution was heated to 80° C. and 92 parts of glycerin was added dropwise over a period of 1 hour. The mixture was subjected to reaction at 100° C. for 4 hours to prepare an isocyanate compound A having a nonvolatile content of 50%. This compound A had isocyanate equivalent of 207 on a solid basis.

(B) Preparation of base resin

A reactor equipped with a reflux condenser, a stirrer, a thermometer and a nitrogen gas blowing pipe was charged with 2,000 parts of Epikote 1007 (epoxy resin of Shell Chemical Co. with epoxy equivalent of 2,000) and 1,000 parts of toluene. The charge was heated to 80° C. to form a uniform solution. Six hundred parts (on a solid basis) of the isocyanate compound A was added dropwise to the solution over a period of 1 hour and the mixture was subjected to reaction at 80° C. for 3 hours. The reaction was found to have ceased when the extinction of absorption (2,270 cm$^{-1}$) by isocyanato groups was verified with an infrared spectrophotometer.

Thus, a urethane-modified epoxy resin having epoxy equivalent of 2,600 was obtained.

To this urethane-modified epoxy resin, 105 g of diethanolamine was added and reaction was performed at 80° C. for 2 hours. Colloidal silica dispersed in an organic solvent was added to the thus obtained base resin in a base resin to silica weight ratio of 100/50, and the ingredients were mixed to prepare a coating solution.

This coating solution was applied by bar coating onto a degreased and chromated (Total Cr=50 mg/m$^2$) Zn-Ni plated steel plate (Ni content=12%; plate deposit=20 g/m$^2$) and the applied coating was baked to form a solid film having an average resin deposit of 1.0 g/m$^2$. The baking conditions were such that the plate was heated to a final temperature of 150° C. within 30 sec. The thus fabricated steel plate with an organic coating was designated sample No. E1 of the present invention.

Additional sample NOs. E2-E21 were fabricated by changing the process conditions including substrate plate, chromate film and resin film composition etc. as shown in Table 1-1.

Comparative sample Nos. CE1-CE11 were also fabricated by employing the process conditions outside the scope of the present invention as shown in Table 1-2.

The film adhesion of the steel plate samples after the electrodeposition coating, the corrosion resistance of blank before electrodeposition coating their workability and asworked corrosion resistance were evaluated by the following methods.

Film adhesion after electrodeposition coating

Power Top U-100 (Nippon Paint Co., Ltd.) was electrodeposited at a voltage of 100 volts in a bath of 28° C. with an electric current applied for 180 sec, and the applied coating was baked at 170° C. for 20 min to form a film in a thickness of 20 μm.

The samples with an electrodeposited coat were spraycoated with Neo amilac B/002 white (Kansai Paint Co., Ltd.) to form a second coat in a thickness of 30 μm. Thereafter, the samples were subjected to a waterproofing secondary adhesion test by the following procedure: the samples were immersed in hot pure water (40° C.) for 240 hours; within 30 min after recovery from the water, 100 cross cuts 1 mm apart were formed through the second coat with a cutter knife and an adhesive tape was applied over the cross-hatched area; the tape was quickly pulled off and the number of squares that were pulled off was counted. The results were evaluated by the following criteria: ◎, 0/100; ○, ≦1/100; Δ, 2−10/100; X, ≧11/100.

Corrosion resistance

The samples were subjected to a cycle corrosion test (CCT) in which one cycle consisted of spraying with 5 wt % NaCl at 35° C. for 4 hours, drying at 60° C. for 2 hours, and leaving in a hot and humid atmosphere (50° C. x 95% r.h.) for 2 hours. The coverage by red rust after 200 cycles was evaluated by the following criteria: ◎, non; ○, <10%; Δ, 10−50%; X, >50%.

Workability

Each of the blank samples (90 $mm^{\Phi}$) was drawn to form a cylinder (50 $mm^{\Phi} \times 25\ mm^{D}$) with a blank holder force of 1 ton. An adhesive tape was applied onto the worked area and quickly pulled off. The amount of the resin coat that was pulled off was measured in milligrams per circumference and the results were evaluated by the following criteria: ◎, <1 mg; ○, 1 to less than 2 mg; Δ, 2 to less than 5 mg; X, >5 mg.

As-worked corrosion resistance

Each of the blank samples (90 $mm^{\Phi}$) was drawn to form a cylinder (50 $mm^{\Phi} \times 25\ mm^{D}$) with a blank holder force of 1 ton. The cylinders were subjected to a cycle corrosion test under the same conditions as described above. After 100 cycles, the coverage by red rust was evaluated by the following criteria: ◎, none; ○, <10%; Δ, 10−50%; X, >50%.

The identification numbers and symbols of epoxy resins, dialkanolamines that appear in Tables 1-1 and 1-2 have the following meanings:

(A) Epichlorohydrin-bisphenol A type epoxy resin:

| | |
|---|---|
| 1. Epikote 1004 | Shell Chemical Co. |
| 2. Epikote 1007 | " |
| 3. Epikote 1009 | " |
| 4. Epikote 1001 | " |
| 5. Epikote 1010 | " |

(B) Isocyanate compound

1. Glycerin adduct of hexamethylene diisocyanate
2. Trimethylolpropane adduct of 2,6-tolylene diisocyanate
3. Polypropylene glycol adduct of m-phenylene diisocynate
4. Polyethyene glycol adduct of p-phenylene diisocyanate (C) Dialkanolamine 1. Diethanolamine
2. Dipropanolamine
3. Dibutanolamine

TABLE 1-1

| | Substrate plate | | Chromate film | | Resin film | | | |
|---|---|---|---|---|---|---|---|---|
| | Chromate | | | | Base epoxy resin | | | |
| *1 Sample No. | Plate type | Plate deposit, g/m² | type | Chromate deposit, mg/m² (as metallic Cr) | Epoxy resin type | Isocyanate compound type | *2 Ratio by weight | Epoxy equivalent |
| E 1 | Zn—Ni | 20 | Coating | 50 | 2 | 1 | 30/100 | 2600 |
| E 2 | Zn—Ni | 20 | Coating | 50 | 2 | 1 | 50/100 | 3000 |
| E 3 | Zn—Ni | 20 | Coating | 50 | 2 | 1 | 10/100 | 2200 |
| E 4 | Zn—Ni | 20 | Coating | 50 | 2 | 2 | 40/100 | 2800 |
| E 5 | Zn—Ni | 20 | Coating | 50 | 2 | 2 | 20/100 | 2400 |
| E 6 | Zn—Ni | 20 | Coating | 50 | 3 | 2 | 50/100 | 4500 |
| E 7 | Zn—Ni | 20 | Coating | 50 | 3 | 3 | 30/100 | 3900 |
| E 8 | Zn—Ni | 20 | Coating | 50 | 3 | 3 | 40/100 | 4200 |
| E 9 | Zn—Ni | 20 | Coating | 50 | 3 | 3 | 20/100 | 3600 |
| E 10 | Zn—Ni | 20 | Coating | 50 | 3 | 4 | 10/100 | 3300 |
| E 11 | Zn—Ni | 20 | Coating | 50 | 1 | 4 | 60/100 | 1600 |
| E 12 | Zn—Ni | 20 | Coating | 50 | 1 | 4 | 40/100 | 1700 |
| E 13 | Zn—Ni | 20 | Coating | 50 | 1 | 4 | 20/100 | 1200 |
| E 14 | Zn—Ni | 20 | Coating | 100 | 2 | 1 | 30/100 | 2600 |
| E 15 | Zn—Ni | 20 | Coating | 200 | 2 | 1 | 30/100 | 2600 |
| E 16 | Zn—Ni | 20 | Coating | 50 | 2 | 1 | 30/100 | 2600 |
| E 17 | Zn—Ni | 20 | Coating | 50 | 2 | 1 | 30/100 | 2600 |
| E 18 | Zn—Ni | 20 | Coating | 50 | 2 | 1 | 30/100 | 2600 |
| E 19 | Zn—Ni | 20 | Electro deposition | 50 | 2 | 1 | 30/100 | 2600 |
| E 20 | Zn—Fe | 40 | Coating | 50 | 2 | 1 | 30/100 | 2600 |
| E 21 | Zn—Mn | 20 | Coating | 50 | 2 | 1 | 30/100 | 2600 |

| | Resin film | | | | | | | | |
|---|---|---|---|---|---|---|---|---|---|
| | Dial-kanolamine | | Silica *3 Ratio | Resin | Baking temper-ature, | Adhesion after electro- | | | |
| *1 Sample No. | Type | No. of moles | by weight | deposit, g/m² | °C. | deposition coating | Corrosion resistance | Work-ability | Corrosion resistance after working |
| E 1 | 1 | 1.0 | 100/50 | 1.0 | 150 | ◎ | ◎ | ◎ | ◎ |
| E 2 | 1 | 0.8 | 100/80 | 1.0 | 150 | ◎ | ◎ | ◎ | ◎ |
| E 3 | 1 | 0.9 | 100/100 | 1.0 | 150 | ◎ | ◎ | ◎ | ◎ |
| E 4 | 1 | 1.0 | 100/50 | 1.0 | 150 | ◎ | ◎ | ◎ | ◎ |
| E 5 | 1 | 1.0 | 100/60 | 1.0 | 150 | ◎ | ◎ | ◎ | ◎ |
| E 6 | 2 | 0.9 | 100/80 | 1.0 | 150 | ◎ | ◎ | ◎ | ◎ |
| E 7 | 2 | 1.0 | 100/70 | 1.0 | 150 | ◎ | ◎ | ◎ | ◎ |
| E 8 | 2 | 1.0 | 100/30 | 1.0 | 150 | ◎ | ◎ | ◎ | ◎ |
| E 9 | 2 | 1.0 | 100/40 | 1.0 | 150 | ◎ | ◎ | ◎ | ◎ |
| E 10 | 2 | 1.0 | 100/50 | 1.0 | 150 | ◎ | ◎ | ◎ | ◎ |
| E 11 | 3 | 0.8 | 100/50 | 1.0 | 150 | ◎ | ◎ | ◎ | ◎ |
| E 12 | 3 | 0.8 | 100/50 | 1.0 | 150 | ◎ | ◎ | ◎ | ◎ |
| E 13 | 3 | 0.8 | 100/50 | 1.0 | 150 | ◎ | ◎ | ◎ | ◎ |
| E 14 | 1 | 1.0 | 100/50 | 1.0 | 150 | ◎ | ◎ | ◎ | ◎ |

TABLE 1-1-continued

| | | | | | | | | | |
|---|---|---|---|---|---|---|---|---|---|
| E 15 | 1 | 1.0 | 100/50 | 1.0 | 150 | ◎ | ◎ | ◎ | ◎ |
| E 16 | 1 | 1.0 | 100/50 | 3.0 | 150 | ◎ | ◎ | ◎ | ◎ |
| E 17 | 1 | 1.0 | 100/50 | 0.5 | 150 | ◎ | ◎ | ◎ | ◎ |
| E 18 | 1 | 1.0 | 100/50 | 1.0 | 130 | ◎ | ◎ | ◎ | ◎ |
| E 19 | 1 | 1.0 | 100/50 | 1.0 | 150 | ◎ | ◎ | ◎ | ◎ |
| E 20 | 1 | 1.0 | 100/50 | 1.0 | 150 | ◎ | ◎ | ◎ | ◎ |
| E 21 | 1 | 1.0 | 100/50 | 1.0 | 150 | ◎ | ◎ | ◎ | ◎ |

*1 Sample No. E1-E21 were all within the scope of the invention.
*2 Ratio by weight = Isocyanate compound/Epoxy resin
*3 Ratio by weight = Composite resin/Silica

TABLE 1-2

| | Substrate plate | | Chromate film | | Resin film | | | |
|---|---|---|---|---|---|---|---|---|
| | Chromate | | | | Base epoxy resin | | | |
| *1 Sample No. | Plate type | Plate deposit, g/m² | type | Chromate deposit, mg/m² (as metallic Cr) | Epoxy resin type | Isocyanate compound type | *2 Ratio by weight | Epoxy equivalent |
| CE 1 | Zn—Ni | 20 | Coating | 50 | 4 | 1 | 50/100 | 750 |
| CE 2 | Zn—Ni | 20 | Coating | 50 | 5 | 1 | 20/100 | 6000 |
| CE 3 | Zn—Ni | 20 | Coating | 50 | 2 | 1 | 5/100 | 2100 |
| CE 4 | Zn—Ni | 20 | Coating | 50 | 2 | 1 | 30/100 | 2600 |
| CE 5 | Zn—Ni | 20 | Coating | 50 | 2 | 1 | 30/100 | 2600 |
| CE 6 | Zn—Ni | 20 | Coating | 50 | 2 | 1 | 30/100 | 2600 |
| CE 7 | Zn—Ni | 20 | Coating | 50 | 2 | 1 | 30/100 | 2600 |
| CE 8 | Zn—Ni | 20 | Coating | 50 | 2 | 1 | 50/100 | 3000 |
| CE 9 | Zn—Ni | 20 | Coating | 50 | 2 | 1 | 50/100 | 3000 |
| CE10 | Zn—Ni | 20 | Coating | 3 | 2 | 1 | 50/100 | 3000 |
| CE11 | Zn—Ni | 20 | Coating | 600 | 2 | 1 | 50/100 | 3000 |

| | Resin film | | | | | | | | |
|---|---|---|---|---|---|---|---|---|---|
| | Dial-kanolamine | | Silica *3 Ratio | | | | | | |
| *1 Sample No. | Type | No. of moles | by weight | Resin deposit, g/m² | Baking temperature, °C. | Adhesion after electro-deposition coating | Corrosion resistance | Work-ability | Corrosion resistance after working |
| CE 1 | 1 | 1.0 | 100/50 | 1.0 | 150 | X | ○ | Δ | Δ |
| CE 2 | 1 | 1.0 | 100/50 | 1.0 | 150 | X | ○ | ◎ | Δ |
| CE 3 | 1 | 1.0 | 100/50 | 1.0 | 150 | Δ | ◎ | Δ | X |
| CE 4 | 1 | 0.2 | 100/50 | 1.0 | 150 | Δ | ○ | ○ | Δ |
| CE 5 | 1 | 2.0 | 100/50 | 1.0 | 150 | X | ◎ | ○ | ○ |
| CE 6 | 1 | 1.0 | 100/5 | 1.0 | 150 | ○ | X | ◎ | X |
| CE 7 | 1 | 1.0 | 100/200 | 1.0 | 150 | Δ | ◎ | X | X |
| CE 8 | 1 | 1.0 | 100/60 | 0.2 | 150 | ◎ | X | ◎ | X |
| CE 9 | 2 | 1.0 | 100/50 | 5.0 | 150 | Δ | ◎ | X | Δ |
| CE10 | 2 | 1.0 | 100/50 | 1.0 | 150 | Δ | X | ◎ | X |
| CE11 | 2 | 1.0 | 100/50 | 1.0 | 150 | ◎ | ◎ | X | Δ |

*1 Sample No. CE1-CE11 were comparative examples.
*2 Ratio by weight = Isocyanate compound/Epoxy resin
*3 Ratio by weight = Composite resin/Silica

What is claimed is:

1. A steel plate with an organic coating having improved corrosion resistance in its as-worked state, comprising:

a steel substrate;

a zinc or zinc alloy-plated layer on the steel substrate;

a chromate film deposited on the zinc or zinc alloy-plated layer to a coating weight of 5 to 500 mg/m² in terms of metallic chromium; and a solid organic film deposited on the chromate film to a coating weight of 0.3 to 4.0 g/m² by applying an organic coating composition on the chromate film;

said organic coating composition having been prepared by mixing 100 parts by weight of epichlorohydrin-bisphenol A epoxy resin and 10 to 100 parts by weight of an isocyanate compound to produce a urethanated epoxy resin having an epoxy equivalent of 1,000 to 5,000, adding 0.5 to 1.0 mole of a dialkanolamine per equivalent of the epoxy group of the urethanated epoxy resin to produce a dialkanolamine-modified urethanated epoxy resin, and mixing 100 parts by weight of the dialkanolamine-modified urethanated epoxy resin with 10 to 150 parts by weight of silica on a solid basis to produce the organic coating composition.

2. A steel plate according to claim 1 wherein said chromate film is deposited to a coating weight of 10 to 200 mg/m² in terms of metallic chromium.

3. A steel plate according to claim 1 wherein said solid organic film is deposited to a coating weight of 0.5 to 2.0 g/m².

4. A steel plate according to claim 1 wherein said dialkanolamine is at least one member selected from the group consisting of diethanolamine, dipropanolamine and dibutanolamine.

* * * * *